US010550498B2

(12) United States Patent
Hofstetter

(10) Patent No.: US 10,550,498 B2
(45) Date of Patent: Feb. 4, 2020

(54) APERIODICALLY WOVEN TEXTILE

(71) Applicant: TECA SA, Balzers (LI)

(72) Inventor: Kurt Hofstetter, Vienna (AT)

(73) Assignee: TECA SA, Balzers (LI)

( * ) Notice: Subject to any disclaimer, the term of this patent is extended or adjusted under 35 U.S.C. 154(b) by 0 days.

(21) Appl. No.: 15/563,209

(22) PCT Filed: Mar. 29, 2016

(86) PCT No.: PCT/AT2016/050079
§ 371 (c)(1),
(2) Date: Sep. 29, 2017

(87) PCT Pub. No.: WO2016/154649
PCT Pub. Date: Oct. 6, 2016

(65) Prior Publication Data

US 2018/0087194 A1 Mar. 29, 2018

(30) Foreign Application Priority Data

Mar. 30, 2015 (AT) ..... A 185/2015

(51) Int. Cl.
*D03D 13/00* (2006.01)

(52) U.S. Cl.
CPC ..... *D03D 13/004* (2013.01)

(58) Field of Classification Search
CPC ..... D03D 13/004; D03D 13/00
See application file for complete search history.

(56) References Cited

U.S. PATENT DOCUMENTS 4,350,341 A 9/1982 Wallace
4,620,998 A 11/1986 Lalvani
(Continued)

FOREIGN PATENT DOCUMENTS

AT 512060 A3 1/2015
AT 512060 B1 2/2015
(Continued)

OTHER PUBLICATIONS

International Search Report for corresponding International Application No. PCT/AT2016/050079, dated Jul. 26, 2016, 7 pages.
(Continued)

*Primary Examiner* — Clinton T Ostrup
*Assistant Examiner* — Andrew Wayne Sutton
(74) *Attorney, Agent, or Firm* — Fitch, Even, Tabin & Flannery LLP

(57) ABSTRACT

Aperiodically woven textile having a square starting pattern (Q) composed of two weft threads and two warp threads. A peripheral rotation point is fixed in the middle of one side, three copies of this starting pattern being rotated successively through 90°, 180° and 270° about said rotation point and positioned in a fan-like manner one behind another to obtain a composed pattern then fixed as the starting pattern (Q) for a corresponding following fan-like composition. This approach iteratively develops patterns of any desired size from crossing points of threads corresponding to the fabric. In the starting pattern (Q), one weft thread, as seen extending from left to right, first crosses over one of the warp threads and then crosses under the other, and the other weft thread crosses over both warp threads, where the threads aperiodically jump orthogonally over one to three threads in the fabric structure.

4 Claims, 4 Drawing Sheets

(56) References Cited

U.S. PATENT DOCUMENTS

| | | | |
|---|---|---|---|
| 5,727,600 | A | 3/1998 | Musha et al. |
| 7,284,757 | B2 | 10/2007 | Geissler |
| 10,145,035 | B2 * | 12/2018 | Goldberg ..... D03D 1/0017 |
| 2004/0065380 | A1 | 4/2004 | Speich |
| 2005/0039662 | A1 | 2/2005 | Skinner et al. |
| 2007/0069463 | A1 | 3/2007 | Geissler |
| 2009/0247034 | A1 | 10/2009 | Goering et al. |

FOREIGN PATENT DOCUMENTS

| | | | |
|---|---|---|---|
| AT | 515438 | A1 | 9/2015 |
| CN | 1141973 | A | 2/1997 |
| CN | 102046865 | A | 5/2011 |
| DE | 69511131 | T2 | 4/2000 |
| EP | 0668382 | A1 | 8/1995 |
| EP | 0742301 | A1 | 11/1996 |
| GB | 1548164 | A | 7/1979 |
| JP | 04-108136 | A | 4/1992 |
| JP | 08-302539 | A | 11/1996 |
| JP | 2004-522870 | A | 7/2004 |
| RU | 2077620 | C1 | 4/1997 |
| RU | 2144579 | C1 | 1/2000 |
| WO | 0185274 | A1 | 11/2001 |
| WO | 2014073864 | A1 | 5/2014 |

OTHER PUBLICATIONS

Russian Decision to Grant and Search Report dated Sep. 5, 2018, for corresponding Russian Application No. 2017135491/12(061886), 8 pgs.

First Office Action in corresponding Austrian Application No. A 185/2015, dated May 20, 2015, 3 pages.

Second Office Action in corresponding Austrian Application No. A 185/2015, dated Oct. 15, 2015, 3 pages.

Notice of Grant in corresponding Austrian Application No. A 185/2015, dated Jun. 22, 2016, 4 pages.

Chinese First Office Action and Search Report dated Mar. 29, 2019, in corresponding Chinese Patent Application No. 201680020306.0, with English Translation (13 pgs.).

Japanese Decision to Grant dated Aug. 28, 2019, in corresponding Japanese Patent Application No. 2018-502291, with machine English translation (5 pages).

* cited by examiner

Fig. 1
Fig. 1A
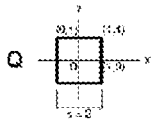
Fig. 1B
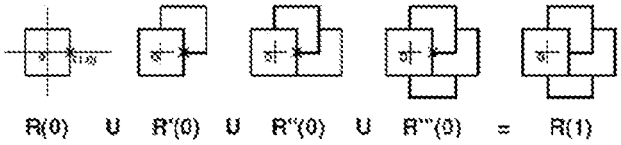
Fig. 1C
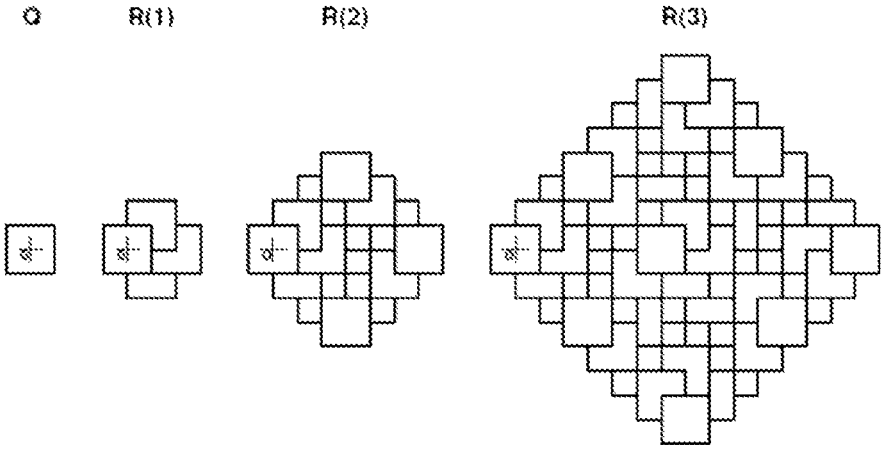

APERIODICALLY WOVEN TEXTILE

CROSS REFERENCE TO RELATED APPLICATIONS

This patent application is the national phase of PCT/AT2016/050079 filed Mar. 29, 2016, which claims the benefit of Austrian Patent Application No. A 185/2015 filed Mar. 30, 2015.

TECHNICAL FIELD

In general, the invention relates to woven textiles, namely woven fabrics of any materials, in particular also technical textiles such as, e.g., woven fabrics of carbon fibers, glass fibers, synthetic fibers, natural fibers, etc.

BACKGROUND and SUMMARY

In particular, the invention relates to an aperiodically woven textile displaying a fabric pattern which is produced in such a manner that, in a square starting pattern (Q) which is composed of two weft threads and two warp threads extending at a right angle with respect thereto, a peripheral rotation point is fixed in the middle of one side, three copies of this starting pattern being rotated successively through 90°, 180° and 270° about said rotation point and being positioned in a fan-like manner, one behind another, in order to obtain a composed pattern which is then fixed as the starting pattern for a corresponding, subsequent, fan-like composition of its successive copies that are rotated by 90°, 180° and 270°, in order to, in this way iteratively develop patterns of any desired size from crossing points of threads corresponding to the fabric.

The invention aims to provide aperiodically woven textiles displaying greater permeability to air and greater tear propagation strength, while the strength in the planar structure—maximum tensile strength—remains the same, compared with other aperiodically or periodically woven textiles.

Aperiodically woven textile material is produced following the method of inductive rotation (IR) by means of computer-controlled weaving machines, cf. in particular publication AT 512060 B, wherein mainly the recursive method of the three-step IR method is explained, which method will still be explained in greater detail hereinafter and is of importance regarding the present production of woven fabrics.

In this case, a fabric is produced by machine, wherein a fabric pattern having a square basic pattern corresponding to a crossing point of threads is arranged several times in the fabric. In doing so, the arrangement is accomplished in that, in a square starting pattern Q that is composed of several square basic patterns, i.e., several crossing points of threads, is fixed in the middle of one side, three copies of this starting pattern being rotated successively through 90°, 180° and 270° about said rotation point and being positioned in a fan-like manner one behind another in order to obtain a composite pattern which is then, in turn, fixed as the starting pattern for a subsequent fan-like composition of its copies that have been successively rotated by 90°, 180° and 270°, in order to, in this way, iteratively develop patterns of any desired size from crossing points of threads corresponding to the fabric, wherein the threads in the fabric cross each other aperiodically and asymmetrically above and below. In doing so, the basic patterns are not invariant if rotated. As the result of a precise overlap of the patterns, the three-step IR method produces, simultaneously, a second, parallel, concealed aperiodic and asymmetric fabric pattern, a background fabric pattern that is located exactly behind it and is different from the fabric pattern that is visible in the foreground.

The basic procedure of the three-step IR method is illustrated, in general, in the examples of FIGS. 1A to 1C, wherein, in an exemplary manner, the starting patterns of each iteration are rotated clockwise and the central easternmost point, i.e., the one the farthest to the right, is fixed as the rotation point. FIG. 1A shows a square starting pattern Q that is composed of several (four) square basic patterns, i.e., several crossing points of threads. In accordance with FIG. 1B, this starting pattern Q is copied in successive steps and rotated about the starting pattern position, cf. steps (R(0), R'(0), R"(0), R'"(0)=R1. The thusly obtained complex pattern R(1) can be transformed, in a corresponding manner by copying and rotating, into an even more complex pattern, cf. the steps or iterations of the recursion Q, R(1), R(2), R(3) in FIG. 1C.

The methods of inductive rotation (see publication AT 512060 B) include recursions, wherein the central easternmost, but also westernmost, southernmost or northernmost, point of the starting patterns is fixed as the rotation point and is rotated clockwise but also counterclockwise.

Publication AT 512060 B discloses as example a starting pattern Q that is composed of four equal thread crossings as shown by FIG. 2. In this starting pattern, all four threads crossings are defined in such a manner that the horizontal thread (weft thread) crosses above and the vertical thread (warp thread) crosses below. In accordance with the three-step IR method the threads in the fabric structure jump aperiodically over up to a maximum of seven threads in an orthogonal manner as shown by FIG. 2A. The woven fabric is characterized by more than four to a maximum of seven threads. The analysis of this fabric structure indeed displays great permeability to air and also tear propagation strength, however, due to the skipping of seven threads, there results a massive reduction of the strength within the planar structure and the tensile strength, respectively.

The invention is based on the critical optimization of fabric structures produced according to the three-step IR method, in view of the strength of the planar structure. To accomplish this, the hereinabove stated textile according to the invention is characterized in that, in the starting pattern (Q), the one weft thread—viewed extending from left to right—first overcrosses one of the warp threads and then undercrosses the other one, and the other weft thread crosses over the two warp threads, as a result of which the threads in the fabric structure of the textile jump aperiodically over one to a maximum of three threads in an orthogonal manner.

Consequently, an increased permeability to air and increased tear propagation strength are achieved while the strength of the planar structure and the maximum tensile strength, respectively, are maintained.

Preferably, an expanded starting pattern is assumed, said pattern being formed by a combination of four such starting patterns as stated hereinabove.

BRIEF DESCRIPTION OF THE DRAWINGS

Specifically, the drawings show in

FIGS. 1A to 1C schematic representations of the various steps of a three-step IR method;

Figure 2:
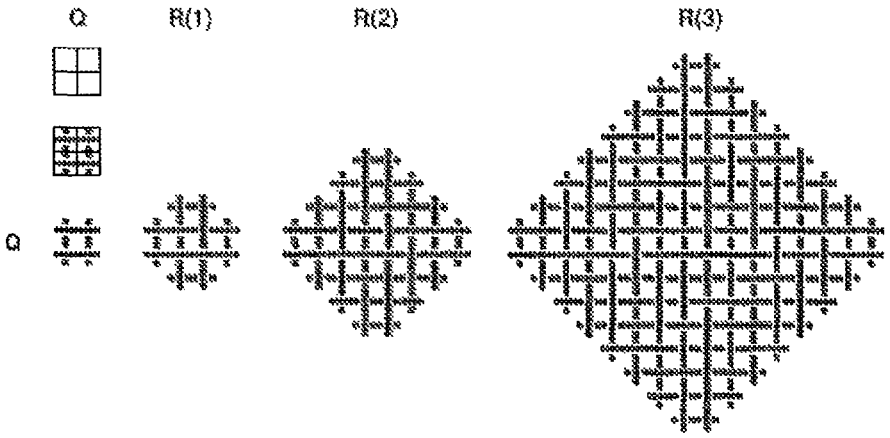
FIGS. 2 to 2A schematic representations of the various steps of a three-step IR method, with the starting pattern Q as disclosed in publication AT 512060 B.
Figure 2A:
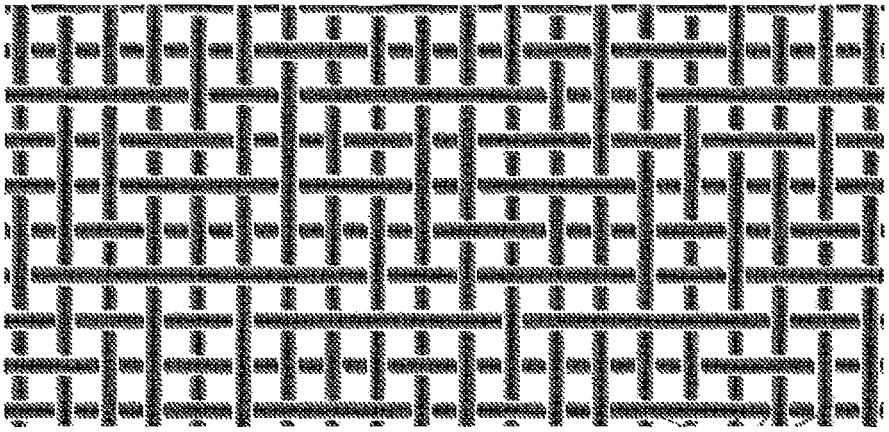
Figure 3:
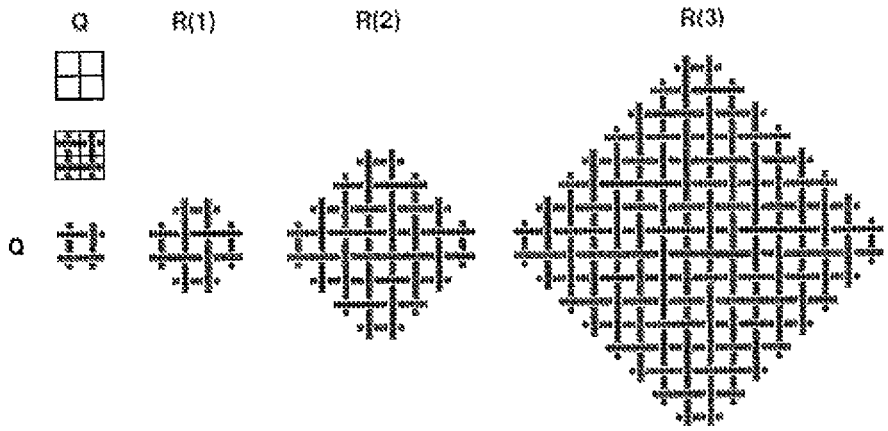
FIGS. 3 to 3A schematic representations of the various steps of a three-step IR method, with the starting pattern Q according to the invention.
Figure 3A:
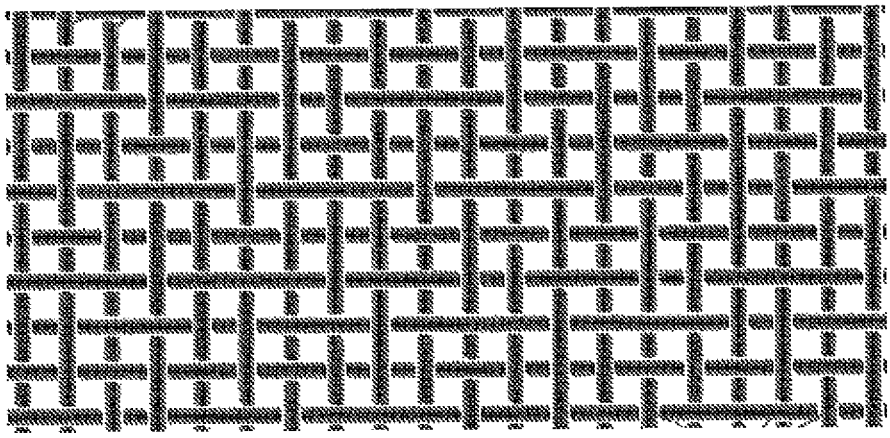

In particular, a highly specific starting pattern Q is formed, said pattern being composed of four thread crossings, wherein the right upper thread crossing is rotated by 90 degrees with respect to the other three thread crossings and, consequently, the vertical thread (warp thread) crosses above and the horizontal thread (weft thread) crosses below, as indicated by FIG. 3. According to the three-step IR method the threads in the fabric structure jump aperiodically over up to a maximum of three threads in an orthogonal manner, as illustrated by FIG. 3A. As a result of this, the strength in the planar structure and the maximum tensile strength, respectively, are maintained despite the aperiodicity and inhomogeneity of the material, as is shown by the results of the tests hereinafter, said tests having been performed by the "Staatliche Versuchsanstalt fuer Textil und Informatik" (national testing center for textile and computer science), cf. table hereinafter. These tests on the textile fabric shown by FIG. 3A, when compared to periodically woven textiles, indicate strikingly greater permeability to air, greater tear propagation strength, however mainly uniform strength in the planar structure and maximum tensile strength, respectively. For example, the results, using the specific starting pattern Q of FIG. 3, display so far overall unknown best textile properties.

The "Staatliche Versuchsanstalt fuer Textil und Informatik" in Vienna (Austria) specifically tested a textile that was aperiodically woven according to the three-step IR method by means of a computer-controlled jacquard weaving machine compliant with EN ISO standards, see test protocol in Table 1 hereinafter. Table 1 identifies this aperiodically woven textile that displays the weaving pattern as shown by FIG. 3A, as the "IR prototype". With the exemplary use of "Tencel" viscose staple fibers, there was determined, compared to exemplary conventional periodically woven fabrics with crepe weave and twill weave with the same warp and weft densities, a greater tear propagation strength in warp direction, as well as in weft direction. Furthermore, due to the aperiodically occurring loose weaving densities, this test indicated a strikingly greater permeability to air. In doing so, the strength of the planar structure—maximum tensile strength—in warp direction remained approximately the same and even increased slightly in weft direction.

TABLE 1

| Feature | Test Standard | Sample 1 | Sample 2 | Sample 3 | Sample 4 | Sample 5 |
|---|---|---|---|---|---|---|
| Weave | | IR Prototype | Crepe | Twill K1/3Z | Linen | Satin A1/725 |
| Wt./unit area (g/m2) | EN 12127 | 145 | 145 | 145 | 135 | 155 |
| Fiber material, viscose staple fibers | | Tencel | Tencel | Tencel | Tencel | Tencel |
| Yarn count warp (twine) | | 10 tex × 2 | 10 tex × 2 | 10 tex × 2 | 10 tex × 2 | 10 tex × 2 |
| Yarn count weft (yarn) | | 10 tex | 10 tex | 10 tex | 10 tex | 10 tex |
| Warp density (thrd/cm) | | 45 | 45 | 45 | 45 | 45 |
| Weft density (thrd/cm) | | 35 | 35 | 35 | 25 | 48 |
| Air permeabl. (l/(min.dm2)) | EN ISO 9237 | 255 | 140 | 66 | 46 | 190 |
| Max tensl str warp dir (daN) | EN ISO 13934 | 152 | 152 | 150 | 156 | 150 |
| Max tensl str weft dir (daN) | EN ISO 13934 | 50.7 | 50.2 | 49.2 | | |
| HK Elongation warp direction (%) | EN ISO 13934 | 15.9 | 17.3 | 16.2 | 18.9 | 13.1 |
| HK Elongation weft direction (%) | EN ISO 13934 | 11.4 | 11.0 | 9.0 | | |
| Tear propagation str warp dir (N) | EN ISO 13937 | 45.5 | 36.8 | 33.4 | | |
| Tear propagation str weft dir (N) | EN ISO 13937 | 63.2 | 58.6 | 51.4 | | |

Furthermore, the tests by the "Staatliche Versuchsanstalt fuer Textil and Informatik" with the use of Tencel twine as the warp thread and polyamide yarn as the weft thread resulted in similar measured results. As can be inferred from Tables 2 and 3 hereinafter, the measurements not only indicated a substantially increased permeability to air and improved tear propagation strength but, above all, also an increased maximum tensile strength and thus better strength in the planar structure.

DETAILED DESCRIPTION

TABLE 2

Measured values of test: Tencel/polyamide
Warp Tencel twine, weft polyamide yarn with maximum density

| Feature/ Tencel - Polyamide | Test Standard | M23 | M25 | M27 |
|---|---|---|---|---|
| Weave | | Crepe 24 bind | Twill K1/3 | IR Prototype |
| Wt./unit area (g/m2) | EN 12127 | 200 | 195 | 214 |
| Fiber material, weft: polyamide | | PA | PA | PA |
| Yarn count warp (twine) | | 10 tex × 2 | 10 tex × 2 | 10 tex × 2 |
| Yarn count weft (yarn) | | 17.5 tex | 17.5 tex | 17.5 tex |
| Warp density (thrd/cm) | | 48 | 48 | 48 |
| Weft density (thrd/cm) | | 33 | 33 | 33 |
| Air permeabl. (l/(min · dm2)) | EN ISO 9237 | 44.3 | 37.5 | 72.5 |
| Max tensl str warp dir (daN) | EN ISO 13934 | 154.9 | 150.1 | 166.0 |
| Max tensl str weft dir (daN) | EN ISO 13934 | 106.6 | 103.1 | 112.3 |
| HK Elongation warp direction (%) | EN ISO 13934 | 23.1 | 22.9 | 22.7 |
| HK Elongation weft direction (%) | EN ISO 13934 | 48.8 | 43.3 | 61.9 |

TABLE 2-continued

| Measured values of test: Tencel/polyamide Warp Tencel twine, weft polyamide yarn with maximum density | | | | |
|---|---|---|---|---|
| Feature/ Tencel - Polyamide | Test Standard | M23 | M25 | M27 |
| Tear propagation str warp dir (N) | EN ISO 13937 | 52.5 | 52.2 | 61.2 |
| Tear propagation str weft dir (N) | EN ISO 13937 | 60.9 | 58.0 | 71.5 |

Source: "Staatliche Versuchsanstalt fuer Textil und Informatik"
Tested by: OStR. Prof. Dipl. Ing. (MS Engineering) Christian Spanner

TABLE 3

| Measured values of test: Tencel/polyamide Warp Tencel twine, weft polyamide yarn with low density | | | | |
|---|---|---|---|---|
| Feature/ Tencel - Polyamide | Test Standard | M24 | M26 | M28 |
| Weave | | Crepe 24 bind | Twill K1/3 | IR Prototype |
| Wt./unit area (g/m2) | EN 12127 | 182 | 180 | 197 |
| Fiber material, weft: polyamide | | PA | PA | PA |
| Yarn count warp (twine) | | 10 tex × 2 | 10 tex × 2 | 10 tex × 2 |
| Yarn count weft (yarn) | | 17.5 tex | 17.5 tex | 17.5 tex |
| Warp density (thrd/cm) | | 48 | 48 | 48 |
| Weft density (thrd/cm) | | 23.1 | 23.1 | 23.1 |
| Air permeabl. (l/(min · dm2)) | EN ISO 9237 | 128.8 | 102.5 | 162.5 |
| Max tensl str warp dir (daN) | EN ISO 13934 | 175.8 | 174.1 | 191.9 |
| Max tensl str weft dir (daN) | EN ISO 13934 | 72.5 | 77.8 | 77.4 |
| HK Elongation warp direction (%) | EN ISO 13934 | 20.8 | 20.6 | 20.7 |
| HK Elongation weft direction (%) | EN ISO 13934 | 53.5 | 55.1 | 69.0 |
| Tear propagation str warp dir (N) | EN ISO 13937 | 68.7 | 67.4 | 86.0 |
| Tear propagation str weft dir (N) | EN ISO 13937 | 73.4 | 75.9 | 85.0 |

Figure 5:
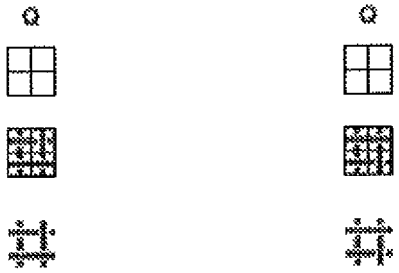
FIG. 5 schematic representations of two starting patterns Q that result due to mutual reflection.

Source: "Staatliche Versuchsanstalt fuer Textil und Informatik"
Tested by: OStR. Prof. Dipl. Ing. (MS Engineering) Christian Spanner Furthermore, using the specific starting pattern Q according to FIG. 3, starting patterns were obtained that result due to rotation or reflection from this specific starting pattern Q, cf. also FIG. 5. With the use of these starting patterns and following the three-step IR method, there result woven fabric structures, wherein the threads jump aperiodically over one to a maximum of three thread in an orthogonal manner—similar to the illustration of FIG. 3A.

Figure 4:
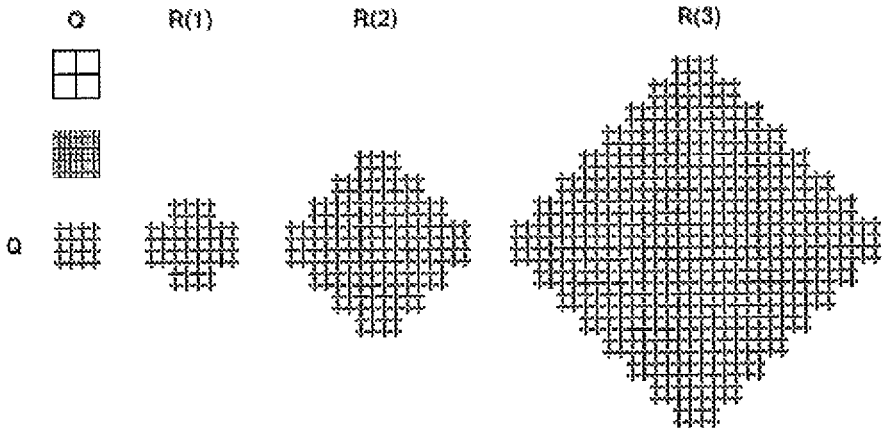
FIGS. 4 to 4A schematic representations of the various steps of a three-step IR method, with a starting pattern Q that is composed of four copies of the starting pattern Q in FIG. 3, said copies being arranged in a square.
Figure 4A:
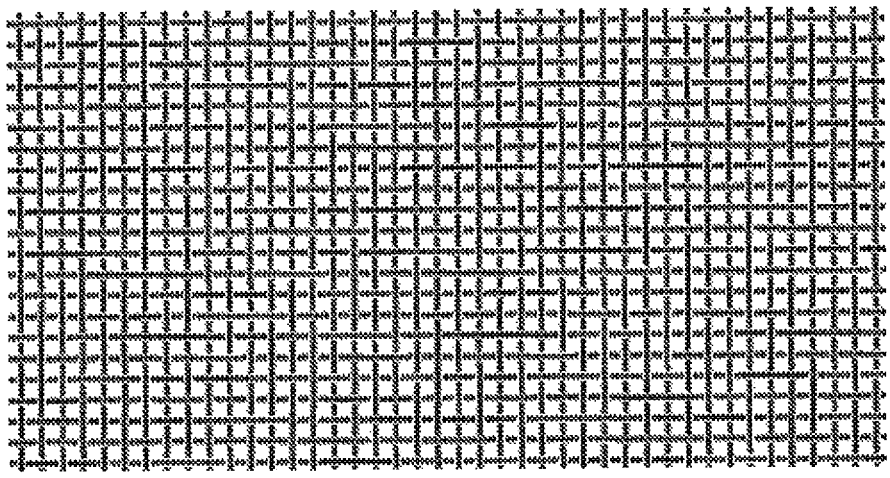

The use of larger starting patterns that form based on the combination of starting patterns of this group in the production of aperiodically woven textiles in accordance with the three-step IR method results in a woven fabric structure, in which the threads jump over more than 3 threads in an orthogonal manner and thus again reduce the strength of the planar structure. As an example, the starting pattern Q in FIG. 4 is formed, in that four copies of the starting pattern Q of FIG. 3 are arranged in a square. According to the three-step IR method a woven fabric structure is generated, wherein the threads jump aperiodically over one to a maximum of five threads in an orthogonal manner—as illustrated by FIG. 4A.

This expansion process for the formation of starting patterns can be combined by linear transformations and be repeated continuously.

The invention claimed is:

1. Aperiodically woven textile having a woven fabric pattern produced by computer control, the woven textile comprising:

a square starting pattern (Q) composed of two weft threads and two warp threads extending at a right angle with respect to said weft threads, a peripheral rotation point fixed in a middle of one side of the square starting pattern (Q), three copies of the starting pattern being rotated successively through 90°, 180° and 270° about said peripheral rotation point and being positioned in a partially overlapping manner, one behind another, to obtain a composite pattern that is fixed as a subsequent starting pattern for a corresponding subsequent partially overlapping composition of its successively rotated copies to iteratively develop a pattern from crossing points of threads, wherein in the starting pattern (Q), a first, upper weft thread of the two weft threads crosses over the two warp threads, while a second, lower weft thread of the two weft threads, as seen extending from left to right, crosses over a first one of the two warp threads and then crosses under a second one of the two warp threads, and wherein within the woven textile any one of the threads a periodically traverse orthogonally one to three threads.

2. Textile according to claim 1, further comprising an expanded starting pattern that is formed by a combination of four starting patterns (Q) according to claim 1.

3. A method of creating a woven fabric pattern, the method comprising:

composing a square starting pattern using two weft threads and two warp threads extending at a right angle with respect to said weft threads, wherein the first weft thread of the two weft threads, as seen extending from left to right, first crosses over a first one of the two warp threads and then crosses under a second one of the two warp threads, and a second of the two weft threads crosses over both of the two warp threads, such that the threads aperiodically jump orthogonally over one to three threads in a fabric structure of the textile;

rotating three copies of the starting pattern successively through 90°, 180° and 270° about a peripheral rotation point fixed in a middle of one side of the square starting pattern, and where the three copies are positioned in a partially overlapping manner, one behind another, to obtain a composite pattern;

fixing a subsequent starting pattern for a corresponding subsequent partially overlapping composition of its successively rotated copies to iteratively develop patterns of any desired size from crossing points of threads in a resulting fabric.

4. The method of claim 3 further comprising using an expanded starting pattern formed by a combination of four of the square starting patterns for rotating successively 90°, 180° and 270° about a peripheral rotation point fixed in a middle of one side of the expanded starting pattern.

* * * * *